United States Patent [19]

Danielson et al.

[11] Patent Number: 4,512,408

[45] Date of Patent: Apr. 23, 1985

[54] MOONPOOL GUIDANCE SYSTEM FOR DRILL STRINGS HAVING ATTACHED UMBILICAL LINES

[75] Inventors: Thomas R. Danielson, Morgan Hill; Donald A. Eberwine, Fremont, both of Calif.

[73] Assignee: Exxon Production Research Co., Houston, Tex.

[21] Appl. No.: 541,621

[22] Filed: Oct. 13, 1983

[51] Int. Cl.[3] ..... E21B 15/02; E21B 41/04

[52] U.S. Cl. ..... 166/349; 175/10; 414/745; 166/352

[58] Field of Search ..... 166/338, 349, 352, 358; 175/7–10, 195; 405/224, 195; 414/22, 745

[56] References Cited

U.S. PATENT DOCUMENTS

| | | | |
|---|---|---|---|
| 3,142,343 | 7/1964 | Otteman et al. | 175/7 |
| 3,907,338 | 9/1975 | Hayes, Jr. et al. | 285/137 R |
| 3,976,132 | 8/1976 | Harper . | |
| 4,325,233 | 4/1982 | Haynes | 175/195 |

*Primary Examiner*—Stephen J. Novosad
*Assistant Examiner*—Bruce M. Kisliuk
*Attorney, Agent, or Firm*—Mitchell D. Lukin; Richard F. Phillips

[57] ABSTRACT

A system for guiding a drill string with an attached umbilical line through a moonpool of a floating structure. The system comprises a support means, and a workhead assembly secured to the outer end of the support means. The workhead assembly is adapted to engage the drill string and umbilical line without damaging the umbilical. The workhead assembly comprises a turntable support, which is secured to the support means, and a turntable. The turntable is positioned about the drill string and umbilical, and rests on the turntable support. Rollers on the turntable allow the drill string and umbilical line to move vertically through the turntable. Roller units on the turntable support allow the turntable and the engaged tool string and umbilical to rotate with respect to the support means.

8 Claims, 11 Drawing Figures

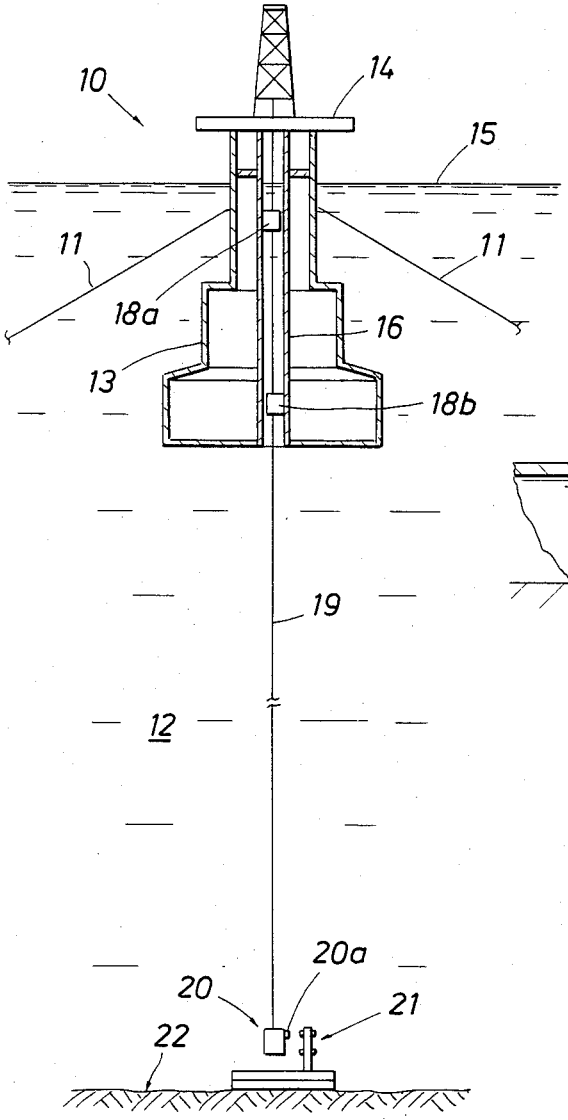
FIG. 1
FIG. 2
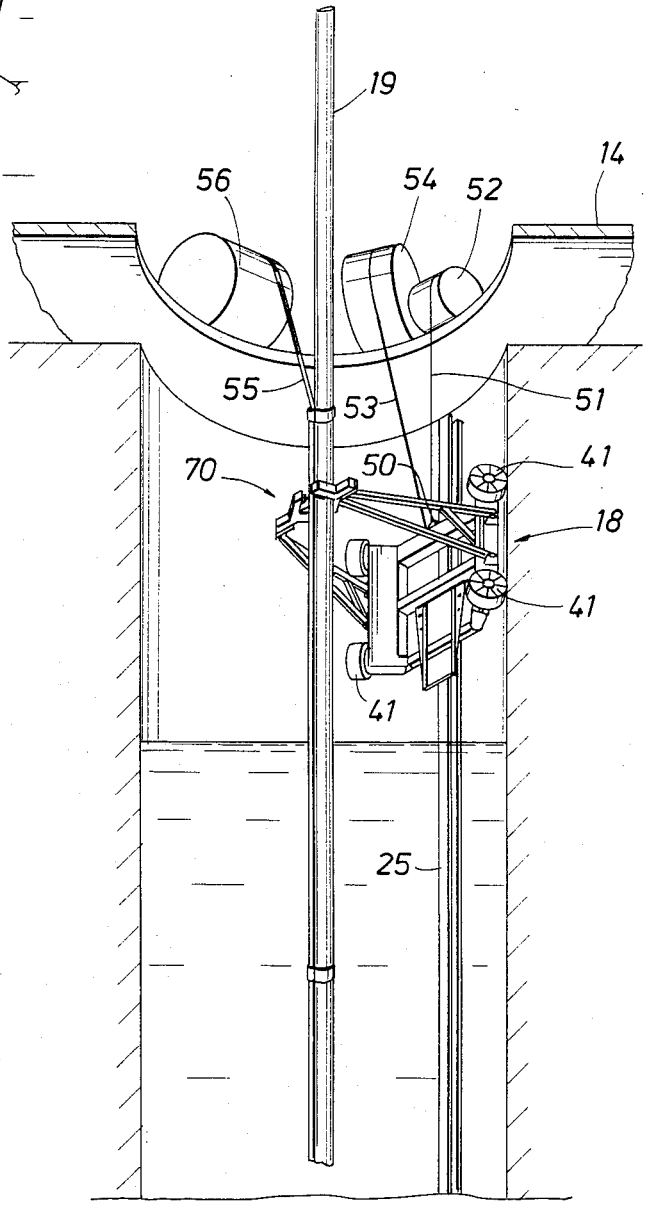

FIG. 9
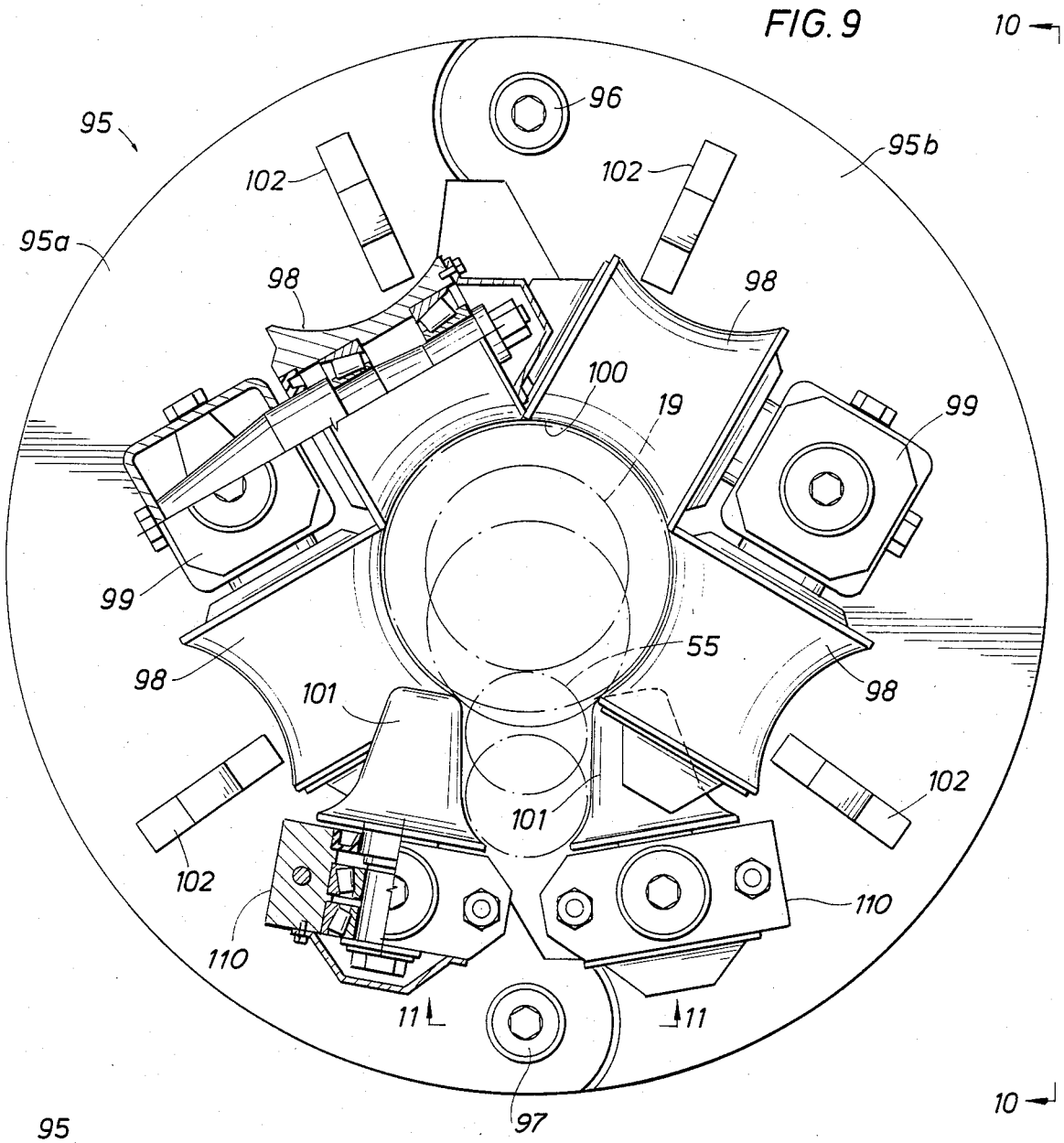
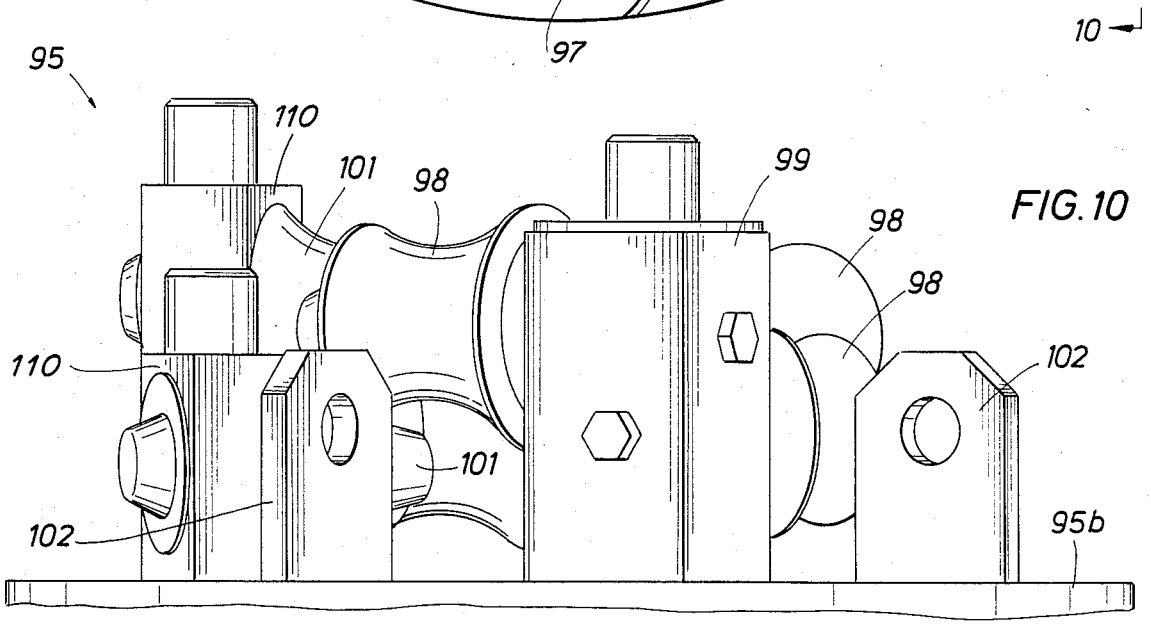
FIG. 10

MOONPOOL GUIDANCE SYSTEM FOR DRILL STRINGS HAVING ATTACHED UMBILICAL LINES

TECHNICAL FIELD

The present invention relates to apparatus for handling drill strings from a floating structure and more particularly relates to a system having a workhead for guiding a drill string with attached umbilical line through a moonpool of a floating structure.

BACKGROUND OF THE INVENTION

Floating structure, such as drill ships and semisubmersibles, have long been used to drill and complete subsea wells. Most of these floating structures have a large-diameter cylindrical opening, known as a moonpool, which extends vertically through the hull of the structure. The moonpool provides access from a work platform on the upper end of the structure into the water below. Most drilling and completion operations are carried out through the moonpool.

The work platform on a floating structure must remain relatively stable during the drilling and completion of a subsea well. In extremely deep waters or in areas subject to high waves and strong winds, providing a stable floating platform can be a problem. One type of floating structure which is particularly adapted for use in such environments is the caisson vessel. A typical caisson vessel has an elongated, cylindrically-shaped hull, formed of concrete. The vessel has ballast tanks or compartments on its lower end and a work platform at its upper end. When in an operable position, the hull is moored vertically in the water with a substantial portion of the hull being submerged.

The submerged portion of the hull of the caisson vessel is relied on to provide stability for the work platform. Once submerged, the bottom of the vessel may be as much as 500 feet below the surface of the water. Thus the moonpool, extending from the work platform completely through the hull, may also be 500 feet long. Unfortunately, it is difficult to raise and lower drill strings and equipment through long moonpools without damaging the moonpool walls or the equipment being handled. In order to prevent damage to the drill strings and equipment or the walls of the moonpool, a system must be provided for centering and guiding the various drill strings as they pass through the moonpool.

One operation which is sometimes carried out through a moonpool is the lowering of a robot tool on a drill string to perform various operations on equipment located on the marine bottom. Since the robot tool is remotely-controlled, an umbilical line for furnishing power to the tool is run along the length of the drill string. The umbilical line is banded or otherwise secured at intervals to the drill string. In guiding such a drill string with its attached umbilical line through the moonpool, the guidance system used must be capable of engaging both the drill string and the umbilical line without damaging the umbilical line. At the same time, the guidance system must allow free vertical movement of the drill string and umbilical line so that they can easily be raised or lowered, as desired.

Providing a guidance system for the drill string and umbilical line is further complicated by the requirement that the robot tool must be capable of rotation once it has reached the depth of the subsea equipment. This is necessary in order to allow the work elements on the robot tool to be properly oriented with respect to the equipment to be worked on. For example, a robot tool with a valve actuator must be rotated by thrusters on the tool to properly position the actuator with respect to the valve to be operated before the actuator can be engaged. Since the robot tool is affixed to the drill string, the drill string with its attached umbilical must also be capable of rotating. Thus the guidance system must allow the drill string to rotate while the system is engaging the drill string.

SUMMARY OF THE INVENTION

The present invention is a guidance system for the moonpool of a floating structure which includes a workhead assembly for guiding a continuous drill string which has an attached umbilical line. The present system includes at least one support apparatus for supporting the workhead assembly in the moonpool. The workhead assembly comprises a turntable support which is attached to the support apparatus, means on the turntable support adapted for rotational movement of a turntable, a turntable which encircles the drill string and umbilical line, and means on the turntable adapted for vertical movement of the drill string and umbilical line.

The turntable support comprises a main beam and two secondary beams. The secondary beams are affixed to the main beam to form a turntable support area. The outer ends of the secondary beams are separated to form an opening through which the drill string with umbilical line is received into the turntable support area. Roller units, each including a retractable, spring-biased latch element, are secured to the main beam and each of the secondary beams to support the turntable.

The turntable comprises a pair of plate-like members which are hinged together. The members can be opened to position the turntable about the drill string and umbilical line. When closed, the members define a central opening which loosely receives the drill string and umbilical line. A first set of rollers is positioned on the members adjacent this opening to guide the drill string while it is being lowered or raised. A second set of rollers on the members guides the umbilical.

In practice, the turntable is first positioned and closed about the drill string and umbilical line. It is then lowered onto the roller units of the turntable support. The turntable is held there by the retractable latch elements of the roller units. The drill string and umbilical line thus engaged can easily move vertically through the turntable and the turntable can rotate with the drill string and umbilical line when the necessity arises.

BRIEF DESCRIPTION OF THE DRAWINGS

FIG. 1 is an elevation, partly in section, of a floating structure incorporating the present invention;

FIG. 2 is a perspective view, partly in section, of a guidance vehicle, used as a support for the present workhead assembly, in an operable position within a moonpool of a floating structure;

FIG. 9 is a plan view, partly in section, of the turntable;

FIG. 10 is a side view of the turntable taken along line 10—10 of FIG. 9; and

DESCRIPTION OF THE PREFERRED EMBODIMENTS

Figure 3:
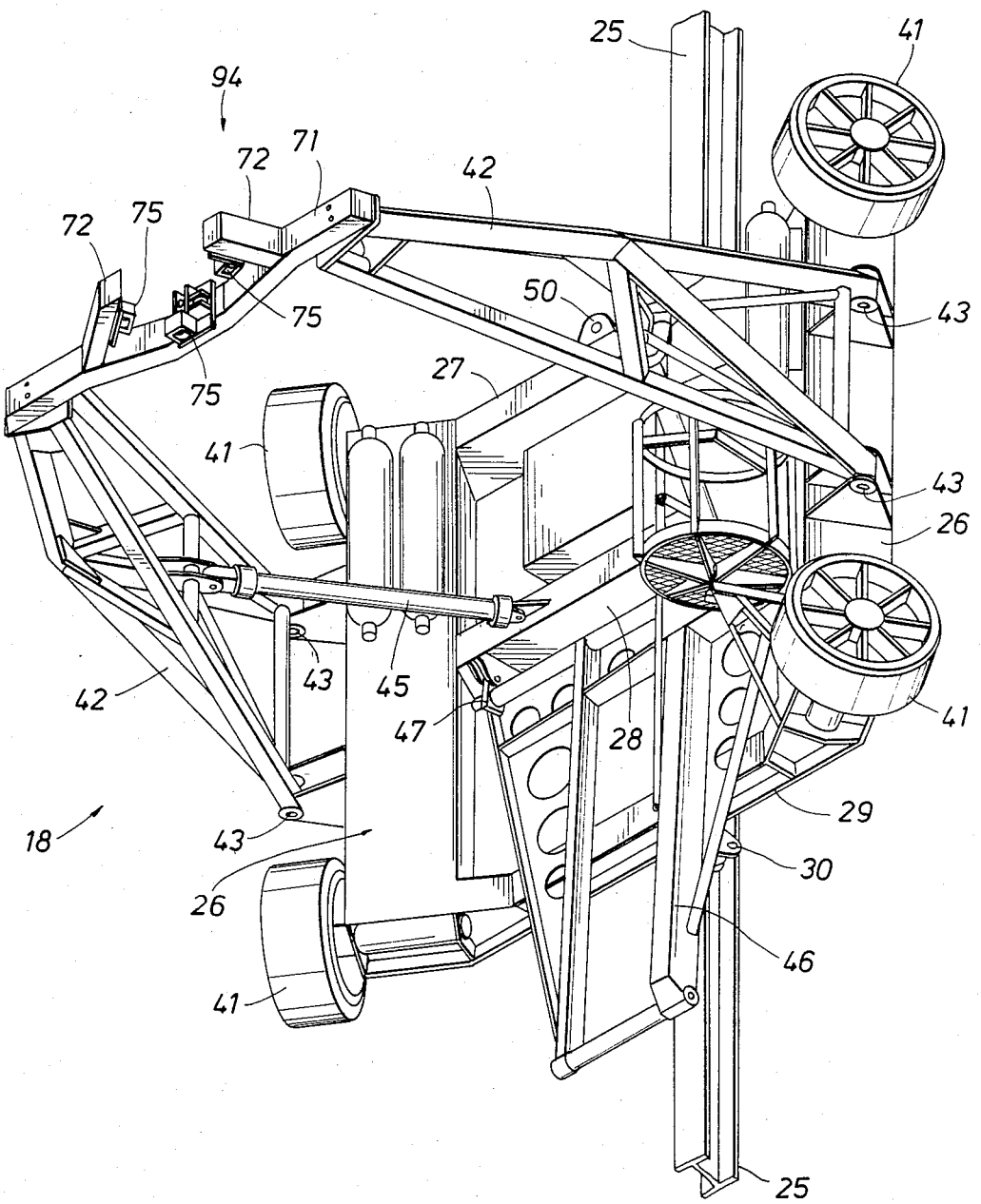
FIG. 3 is a perspective view of a guidance vehicle with the workhead of the present invention mounted on it.

Referring to the drawings, FIG. 1 discloses a floating drilling and completion structure, caisson vessel 10, which is moored by anchor lines 11 in body of water 12. As illustrated, vessel 10 has a stepped, cylindrically-shaped hull 13 which is vertically positioned in the water. When in an operable position, a substantial portion of hull 13 is submerged in order to provide a relatively stable work platform 14 above surface 15. A central opening (moonpool 16) is formed through the vertical axis of hull 13. Drilling and completion operations are carried out from platform 14 through moonpool 16. Although structure 10 is described throughout as a caisson vessel, it should be recognized that the system of the present invention can be used equally as well within the moonpools of other floating structures without departing from the present invention.

In carrying out operations from vessel 10, various drill strings 19 and equipment must be raised and lowered through moonpool 16. The length of moonpool 16 is substantial in a typical caisson vessel. A guidance system must be provided to guide the drill strings and equipment through the moonpool to prevent damage to the equipment or to the walls of the moonpool. One such moonpool guidance system is fully disclosed in Ser. No. 541,620, filed on Oct. 13, 1983.

In the preferred embodiment, this guidance system comprises two guidance vehicles 18*a*, 18*b* (FIG. 1), which are mounted opposite each other on the walls of moonpool 16. Each vehicle is mounted on a separate monorail 25 (only one shown in FIG. 2) in such a way that the vehicles are free to move up and down the wall of the moonpool. Each monorail is secured to the wall of moonpool 16. The monorails extend from the top of moonpool 16 to a point near the lower end of the moonpool.

Each guidance vehicle 18 (only one shown in FIG. 2) is supported in the moonpool by line 51 from winch 52 located on platform 14. This line, used for raising and lowering the guidance vehicle, is attached to fitting 50. The remaining details of FIG. 2 are discussed more fully below. The guidance vehicles are identical, so only one will be described in detail.

Referring to FIG. 3, guidance vehicle 18 has a frame having two side structures 26 and upper, intermediate, and lower cross supports 27, 28, 29. The frame is mounted on I-shaped monorail 25 by roller assemblies 30 (only one shown in FIG. 3) which are affixed to the back of cross supports 27, 29. Each roller assembly 30 includes rollers which roll in the channels of monorail 25. The roller assembly prevents the frame from leaving the monorail. Mounted on each corner of the frame are wheels 41 which are supported by roller bearings positioned on spindles. Wheels 41 roll against the moonpool wall.

Two identical side arm assemblies 42 are mounted at either side of the frame by vertical pivot pins 43. Each arm 42 is a truss structure having an outer end to which a tool-handling workhead (to be described below) can be attached. Remotely controlled hydraulic cylinders 45 (only one shown in FIG. 3) are connected between cross support 28 and side arms 42 to rotate the side arms about their pivots. An umbilical 53 from winch 54 (FIG. 2) controls cylinders 45 and other equipment on vehicle 18. Center arm 46 (FIG. 3) is mounted on cross support 28 about horizontal pivot 47 so that the arm can be swung up to an operable or closed position, or down to a stowed or open position. Fitting 50 for lift line 51 is affixed to upper cross support 27.

Returning, for purposes of discussion, to the apparatus shown in FIG. 1, in carrying out drilling and completion operations from vessel 10, various drill strings and equipment will be guided by vehicles 18*a*, 18*b*. To accomplish this task, interchangeable workhead assemblies are used. When needed, these assemblies are attached to the outer end of the arms of vehicles 18*a*, 18*b*. The present invention includes a workhead which can be used with these vehicles. The above system is the preferred means for supporting such a workhead.

One operation calling for a workhead is illustrated in FIG. 1. Here, guidance vehicles 18*a*, 18*b* are shown guiding a drill string 19 which is being used to lower and support working tool 20. Working tool 20 (the details of which form no part of the present invention) may be any of several remotely-controlled units which are used to carry out a variety of subsea operations. For example, a typical working tool 20 may include a wrench means 20*a*. When properly aligned with a submerged wellhead 21 on the marine bottom 22, wrench means 20*a* may be used to operate a valve on the wellhead. Umbilical 55 from winch 56 (FIG. 2) is strapped to drill string 19. This umbilical line extends the length of drill string 19 to furnish power for wrench means 20*a* on working tool 20. Since working tool 20 must be oriented rotationally with respect to wellhead 21, the entire length of drill string 19 and attached umbilical line 55 must be free to rotate in either direction. Therefore, the workhead used for this operation must be capable of engaging drill string 19 without damaging attached umbilical line 55 while allowing both vertical and rotational movement of both the drill string and umbilical line.

Figure 5:
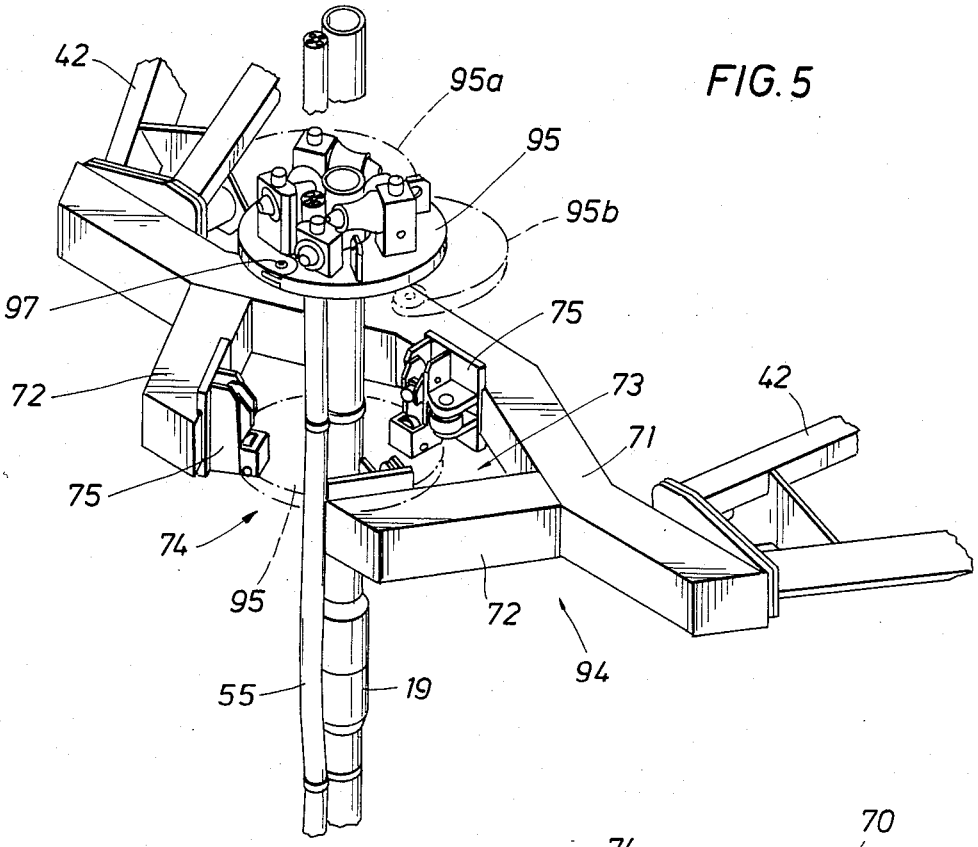
FIG. 5 is a perspective view of the workhead assembly of the present invention.
Figure 4:
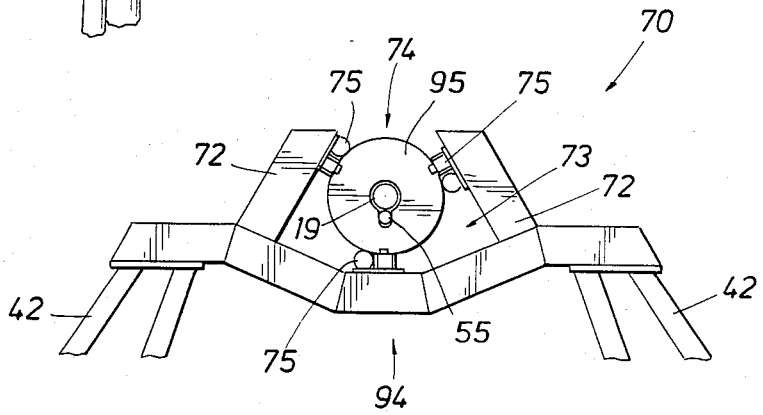
FIG. 4 is a simplified plan view of the present workhead assembly.

Workhead 70 (FIG. 4) is provided for handling drill string 19 and attached umbilical line 55. Workhead 70 comprises turntable support 94 (FIGS. 3, 4 and 5) and turntable 95 (FIGS. 4 and 5). Turntable support 94 is made up of main beam 71, secondary beams 72, and roller units 75. Main beam 71 of turntable support 94 has its ends bolted to side arms 42 of vehicle 18 when the side arms are in their closed positions. Center arm 46, shown in FIG. 3, is not used with workhead 70. Secondary beams 72 are mounted on main beam 71 and are spaced as shown in FIGS. 4 and 5 to form turntable support area 73. As seen in the figures, turntable support area 73 is open at its front 74 so that it can be maneuvered about drill string 19 and umbilical line 55 without requiring the drill string or umbilical to be disconnected. Mounted on each side beam 72 and on main beam 71 within turntable support area 73 is a roller unit 75. All of roller units 75 are identical so only one will be described in detail.

Figure 6:
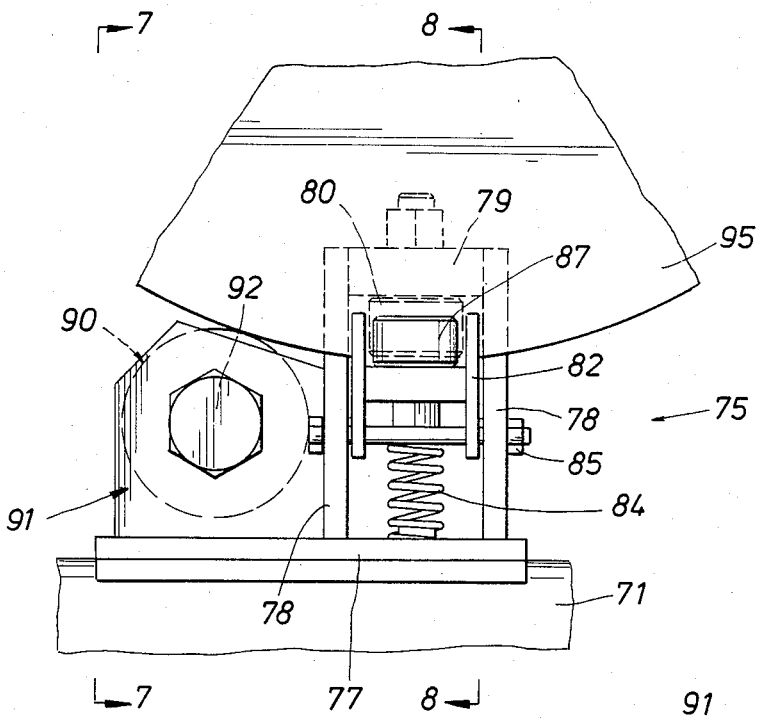
FIG. 6 is a plan view of a roller unit of the turntable support.
Figure 7:
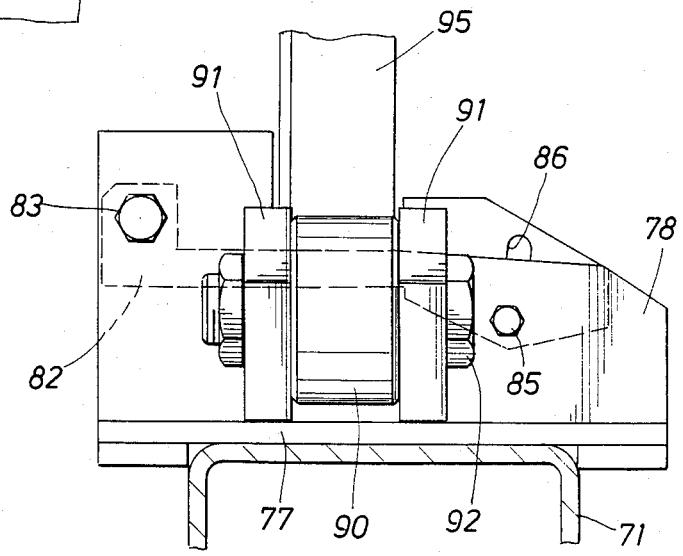
FIG. 7 is a simplified view of a roller unit of the turntable support along line 7—7 of FIG. 6.
Figure 8:
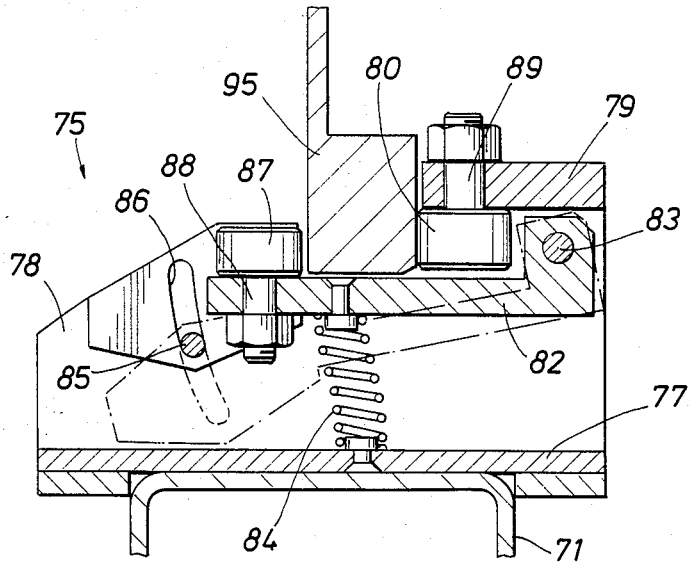
FIG. 8 is a sectional view taken along line 8—8 of FIG. 6.

As seen in FIGS. 6–8, roller unit 75 includes a baseplate 77 on which a pair of spaced supports 78 are mounted. Baseplate 77 is, in turn, welded or otherwise attached to main beam 71, as illustrated, or to side beams 72. Brace 79 is secured between supports 78. Axle 89 for roller 80 is attached to brace 79. Latch element 82 is mounted about a pivot between supports 78 by means of bolt 83. Latch element 82 is normally biased outward from baseplate 77 by spring 84. A bolt 85 through supports 78 passes through curved slots 86 in latch element 82. Bolt 85 acts cooperatively with slots 86 to guide and limit the travel of the latch element.

A second roller 87 is mounted on latch element 82. When in an operable position, roller 87 has its axle 88 parallel to axle 89 of first roller 80 (FIG. 8). Mounted at one side of supports 78 is a third roller 90 (FIGS. 6 and 7). Roller 90 is mounted between two support members 91. Support members 91 are attached to baseplate 77 and one of supports 78. Axle 92 of roller 90 is offset and perpendicular to axles 89 and 88 of the first and second rollers. The operation of turntable support 94 and roller units 75 will be described below.

Figure 11:
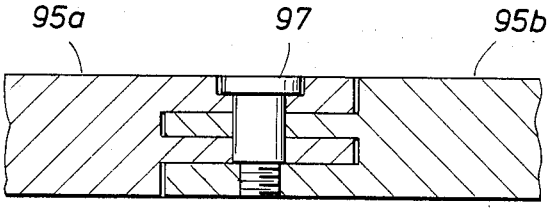
FIG. 11 is a sectional view taken along line 11—11 of FIG. 9.

Turntable 95 is schematically shown in FIGS. 4 and 5, and illustrated in detail in FIGS. 9–11. As seen in FIG. 9, turntable 95 comprises two plate-like members 95*a*, 95*b* which can be opened about hinge pin 96, by removing pin 97, to allow the turntable to be positioned around drill string 19 and umbilical 55. Preferably, both members 95*a*, 95*b* have a tongue-and-groove construction at their mating surfaces as shown in FIG. 11. This insures that the upper and lower surfaces at the periphery of turntable 95 will be smooth when members 95*a*, 95*b* are in a closed position. This will prevent any obstructions to smooth rotation due to uneven surfaces when turntable 95 is positioned on turntable support 94.

Two sets of dual rollers 98 (saddle rollers) are cantilevered from posts 99 (FIGS. 9 and 10). Posts 99 are mounted on turntable members 95*a*, 95*b*. Rollers 98 are positioned over opening 100, which is generally circular in shape, but in any event is the area between members 95*a*, 95*b* when those members are in a closed position. Rollers 98 are intended to contact the drill string as it passes through opening 100 much as is shown in FIGS. 4 and 5. A second set of rollers 101 (tapered rollers) are similarly mounted from posts 110 on turntable members 95*a*, 95*b* in a position to guide umbilical line 55 when the turntable members are in a closed position. The dotted lines in opening 100 in FIG. 9 indicate different positions which drill string 19 and umbilical line 55 may occupy within that opening in turntable 95. Both saddle rollers 98 and tapered rollers 101 desirably have sealed, tapered roller bearings. It is also desirable that these bearings be lubricated by a pressure-compensated means to avoid sea water invasion. Lifting eyes 102 are provided on members 95*a*, 95*b* to aid in installation and removal of turntable 95.

Returning, for the purposes of illustration, to FIG. 5, as the inventive device operates, side arms 42 of vehicle 18 are closed and turntable support 94 is attached to the arms. Turntable support 94 is then positioned around drill string 19 and attached umbilical 55. Turntable 95 is opened, as shown by the dotted lines in upper portion of FIG. 5, and positioned around drill string 19 and umbilical line 55. Turntable 95 is closed and members 95*a*, 95*b* are secured together. As shown by the broken line in FIG. 8, latch elements 82 of roller units 75 are pushed back against springs 84 as turntable 95 is lowered onto turntable support 94. Turntable 95 rests on first rollers 80 of roller units 75. Latch elements 82 are released as turntable 95 passes and springs 84 act to position second rollers 87 adjacent the upper surface of turntable 95. Rollers 87 resist upward movement of turntable 95. When turntable 95 is so positioned, third rollers 90 will resist the lateral movement of turntable 95 and maintains it generally in the center of turntable support 94. To remove turntable 95 and turntable support 94, the above steps are reversed.

It can be seen that turntable 95 guides drill string 19 and attached umbilical 55 therethrough without damage. At the same time, rollers 98 and 101 on members 95*a*, 95*b* allow the drill string and umbilical line to move easily through turntable 95. When drill string 19 and umbilical line 55 are required to rotate they can do so, since turntable 95 is free to rotate on the rollers of turntable support 94.

The foregoing disclosure and description of the invention are only illustrative and explanatory thereof. Various changes in size, shape, materials of construction and configuration as well as in the details of the illustrated construction may be made within the scope of the appended claims without departing from the spirit of the invention.

What is claimed is:

1. A system for guiding a continuous drill string with attached umbilical line through a moonpool of a floating structure comprising:

a means for supporting a workhead assembly within the moonpool; and a workhead assembly adapted to engage and guide said drill string with attached umbilical line;

wherein said workhead assembly comprises:

a turntable having a central opening and adapted to be positioned about both said continuous drill string and said umbilical line;

means on said turntable adapted to allow vertical movement of said drill string and umbilical line through said turntable; and a turntable support including means for rotatably supporting said turntable;

whereby said continuous drill string with attached umbilical line can be guided and held generally in the center of said moonpool.

2. The system of claim 1 wherein said turntable comprises:

a pair of plate-like members;

means for pivotably connecting said plate-like members at one point so that when in an open position said members can be positioned about the continuous drill string and attached umbilical line, and so that when in a closed position said members define a central opening in which said continuous drill string and umbilical line may be positioned; and means for securing said members in said closed position.

3. The system of claim 2 wherein said means on said turntable adapted to allow vertical movement of said drill string and umbilical line comprises:

a first set of rollers mounted on said turntable adjacent the central opening and adapted to guide said continuous drill string during vertical movement of said continuous drill string through said central opening; and a second set of rollers mounted on said turntable adjacent said central opening and adapted to guide said umbilical line during vertical movement of said umbilical line through said central opening.

4. The system of claim 3 wherein said turntable support comprises:

a main beam;

a pair of secondary beams, each secured at one end to said main beam and extending outward therefrom, said secondary beams being spaced from each other on said main beam so that the ends of said secondary beams not attached to said main beam define an opening between them through which the continuous tool string and attached umbilical line are received into said turntable support;

and wherein said means for rotatably supporting said turntable comprises roller units secured to the main beam and each of the secondary beams.

5. The system of claim 4 wherein each of said roller units comprises:

a baseplate which is secured to one of said main or secondary beams, a first roller on which the bottom, flat side of said plate-like turntable rests, said first roller being mounted between a first set of supports on said baseplate;

a latch element pivotably mounted between said first supports on said baseplate;

a second roller mounted on said latch element and adapted to resist upward movement of said turntable when said latch element is in an operable position and the turntable is below the roller;

a spring means for forcing said latch element to said operable position; and a third roller mounted between a second set of supports on said baseplate and adapted to resist the lateral movement of said turntable.

6. The system of claim 1, wherein said means for supporting said workhead assembly within the moonpool is a guidance vehicle comprising:

a frame;

means for mounting said frame on the wall of said moonpool and allowing the vehicle to move vertically within the moonpool;

arms having first and second ends and mounted at their first ends to said frame and extending outward into said moonpool, said workhead assembly being connected between the second ends of said arms; and means for moving said frame vertically within said moonpool.

7. A turntable for use in guiding a continuous drill string with attached umbilical line through a moonpool of a floating structure, comprising:

a pair of plate-like members;

means for pivotably connecting said plate-like members at one point so that when in an open position said members can be positioned about said continuous drill string and attached umbilical line, and so that when in a closed position said members define a central opening in which said continuous drill string and attached umbilical are positioned; and means for securing said members in said closed position; whereby said continuous drill string with attached umbilical line may be guided through and held generally in the center of said moonpool; said plate-like members being adapted to allow free longitudinal movement of said drill string through said plate-like members, and being adapted to rotate with said drill string in response to rotation of said drill string such that the angular orientation of said plate-like members to said drill string remains constant when said plate-like members are in the closed position.

8. The turntable of claim 7 further comprising:

a first set of rollers mounted on said turntable adjacent the central opening and adapted to guide the continuous drill string during vertical movement of said continuous drill string and umbilical line through said central opening; and a second set of rollers mounted on said turntable adjacent said central opening and adapted to guide the attached umbilical line during vertical movement of said continuous drill string and attached umbilical line through said central opening.

* * * * *